US005348100A

United States Patent [19]

Ramey

[11] Patent Number: 5,348,100

[45] Date of Patent: Sep. 20, 1994

[54] APPARATUS AND METHOD FOR CONTROLLING OILWELL FIRE

[76] Inventor: Larry E. Ramey, 4612 Amesbury Dr., #284, Dallas, Tex. 75206

[21] Appl. No.: 868,959

[22] Filed: Apr. 16, 1992

[51] Int. Cl.[5] ..... A62C 3/06

[52] U.S. Cl. ..... 169/69; 169/49

[58] Field of Search ..... 169/69, 43, 46, 47, 169/48, 49, 52

[56] References Cited

U.S. PATENT DOCUMENTS

| | | | |
|---|---|---|---|
| 1,857,788 | 5/1932 | Murphy | 169/69 X |
| 4,083,908 | 4/1978 | Kalvenes et al. | 414/788.4 X |
| 4,083,909 | 4/1978 | Göransson | 414/792.6 X |
| 4,323,118 | 4/1982 | Bergmann | 169/69 X |
| 4,356,869 | 11/1982 | Buttrey | 169/49 |
| 4,641,711 | 2/1987 | Terry | 169/46 X |

*Primary Examiner*—David M. Mitchell
*Assistant Examiner*—Andrew C. Pike
*Attorney, Agent, or Firm*—Richards, Medlock & Andrews

[57] ABSTRACT

A technique for controlling an oilwell fire is provided which utilizes boxes (10, 40, 60) formed of autoclave cellular concrete. This material is sufficiently heat resistant to survive the temperatures of a burning oilwell and provide the possibility of extinguishing the fire and creating a mechanism to put the oilwell back into production with relative ease.

1 Claim, 5 Drawing Sheets

APPARATUS AND METHOD FOR CONTROLLING OILWELL FIRE

TECHNICAL FIELD OF THE INVENTION

This invention relates to an invention for controlling oilwell fires, and in particular to use of an autoclave cellular concrete system to control the oilwell fire.

BACKGROUND OF THE INVENTION

The most recent events in Kuwait have created an enormous demand for improved techniques and devices to control oilwell fires. In a typical oilwell fire, such as those in Kuwait, a break will occur in the piping above or near the surface which permits uncontrolled release of oil and gas. Any ignition source can start the escaping oil and gas burning.

A burning oilwell fire is difficult to extinguish for a number of reasons. First, the intense heat generated by the burning hydrocarbons make it very difficult to work around the well and special materials resistant to those temperatures are required. Even if the fire is put out, the well must be capped to stop the uncontrolled release of oil and gas waiting for yet another ignition source to reignite.

The traditional technique of capping the oilwell once the fire is extinguished is to remove what is remaining of the original control valve of the well. A new control valve must then be installed and properly mounted to the remaining well structure. The new valve is commonly a Christmas tree, which is an assembly of valves and pipe sections which is used to control the well and direct production to a desired location in normal operation. In such situations, parts of the Christmas tree are commonly of brass to minimize the chance of a spark, which could simply reignite the fire. Moreover, the consequences of a reignition are particularly severe when it is realized that the personnel working around the well are in grave danger.

A need exists for improved devices and methods of controlling an oilwell fire which minimizes the risk to operators and efficiently and quickly returns the well to production.

SUMMARY OF THE INVENTION

In accordance with one aspect of the present invention, an apparatus is provided for extinguishing an oilwell fire. The apparatus includes a box formed of autoclave cellular concrete having four sides and a top. The box is placed over the burning oilwell to control the fire. The autoclave cellular concrete will survive the elevated temperatures of the fire and the box will maintain integrity. Structure can be provided for filling the interior of the box about the well with powdered or crumbled autoclave cellular concrete or other fire retardant to deprive the fire of oxygen and put the fire out. The box can be formed with vent holes in the top to prevent overpressurization of the interior of the box prior to filling the box with material to extinguish the fire.

In accordance with another aspect of the present invention, a second box is provided, also formed of autoclave cellular concrete. The second box is sized to fit over the first box. The second box has four sides and a top, at least one of the sides having vent holes formed therethrough. Oil and gas from the well will be directed out the vent holes in the sides of the second box.

In accordance with yet another aspect of the present invention, a third box of autoclave cellular concrete is provided which is sized to fit over the second box. The third box has four sides and a top. A discharge valve is mounted through a wall of the third box so that oil and gas within the interior of the box from the oilwell can be discharged from the discharge valve for storage.

The autoclave cellular concrete boxes are preferably formed of panels of autoclave cellular concrete secured together by threaded fasteners.

BRIEF DESCRIPTION OF THE DRAWINGS

For a more complete understanding of the present invention and the advantages thereof, reference is now made to the following Description taken in conjunction with the accompany drawings, in which.

DETAILED DESCRIPTION

An oil fire, such as those found in Kuwait at this time, typically is created when the well pipe above or near the ground surface ruptures and the resulting discharge of crude oil and natural gas is ignited. As noted, the conventional technique is to extinguish the fire, often with an explosive charge, and then replace the ruptured pipe section with a blowout preventer and a new element commonly called the Christmas tree valve, permitting the well to be controlled.

Figure 1:
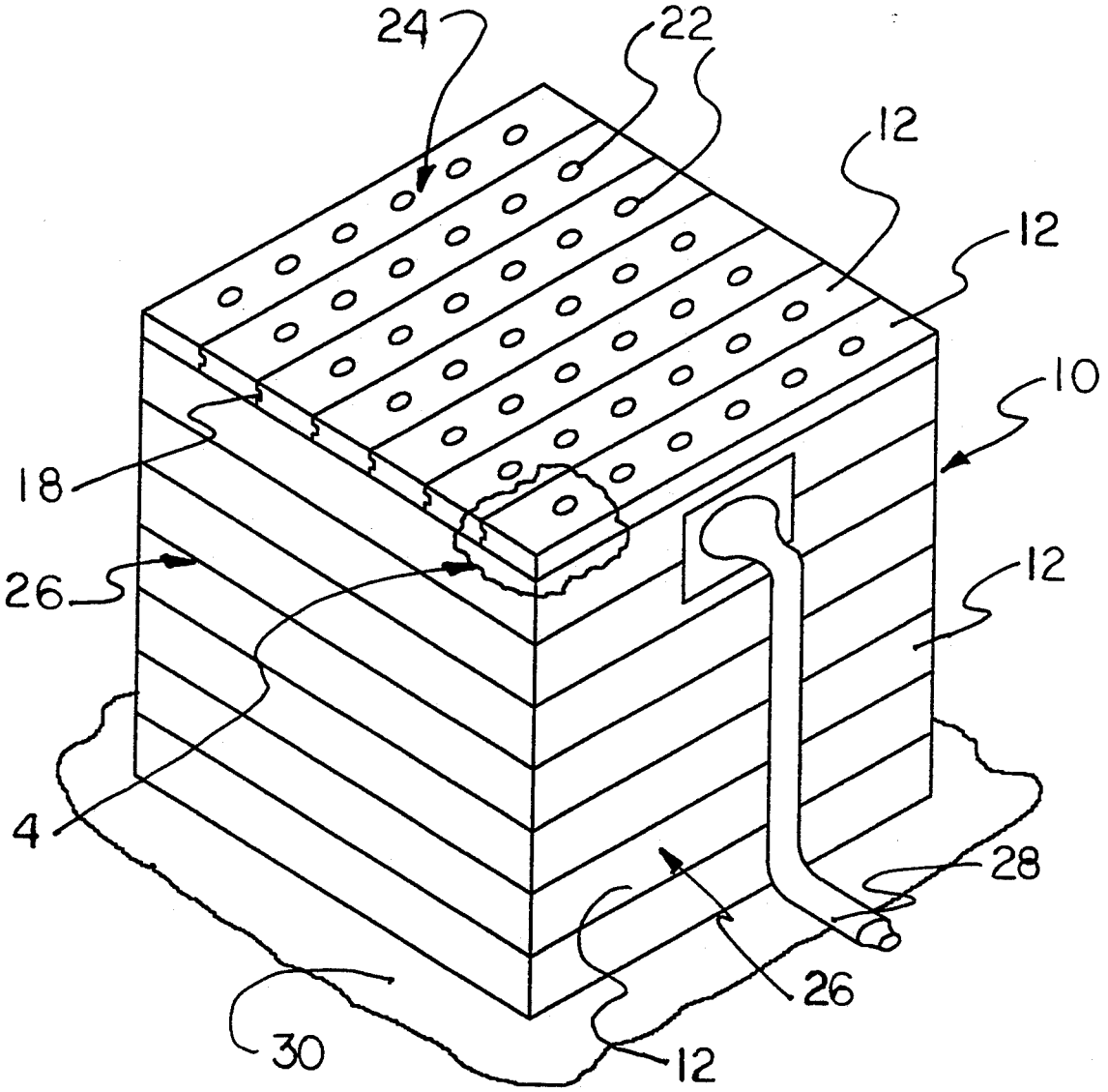
FIG. 1 is a perspective view of a first box forming an embodiment of the present invention.
Figure 4:
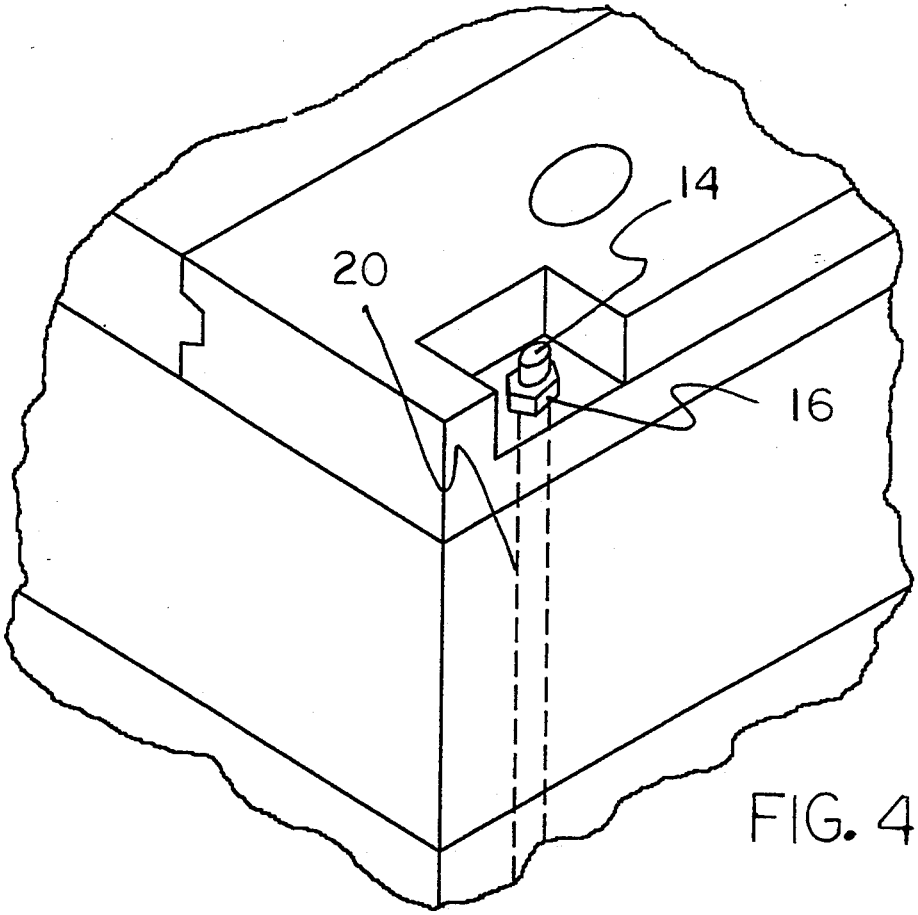
FIG. 4 is a detailed view of a threaded fastener used to secure the autoclave cellular concrete panels of a box together.

With reference now to FIG. 1, a box 10 is illustrated which forms one embodiment of the present invention and is usable to extinguish and control an oilwell fire. The box 10 is an assembly of panels 12 of autoclave cellular concrete. These panels 12 are held together by through bolts 14 and nuts 16, as seen in FIG. 4, which pass through suitable bolt holes formed in the panels themselves. The block out where the nut is tightened on the bolt can be patched after the bolt is tightened.

Autoclave cellular concrete is a material which has very special properties desirable for the application set out hereinafter. Autoclave cellular concrete is typically a mix of quartz sand, cement and lime. Substitutes for the sand include slag, pulverized fuel-ash, or other silicious fine aggregates. The formation process generates a large quantity of air spaces within the concrete. The spaces can be formed in a slurry of the mix by formation of gas by chemical reaction within the mass during the liquid or plastic stage of the mix or by adding to the slurry in the mixer a preformed stable foam or incorporating air by whipping. The slurry is then cast into steel moulds, and the cast material is then cut into the desired products such as slabs or blocks while still relatively soft. High pressure steam curing is then used to complete the process. After curing, further shaping can be preformed in milling machines. The autoclave cellular concrete has ten time the insulation value of ordinary concrete and has 1/5th the density of ordinary concrete. Holes or apertures can be drilled into or through the material with conventional wood working tools. Autoclave cellular concrete is available in many preformed shapes from Internationella Siporex Aktiebolaget of Malmo, Sweden and Hebel International GmbH Co. of Germany. One technique for production of slabs from such autoclave cellular concrete is disclosed in U.S. Pat. Nos. 4,083,908 and 4,083,909 issued Apr. 11, 1978, which patents are incorporated herein by reference in their entirety.

Among the many advantages of autoclave cellular concrete is the ability to machine the concrete to close tolerances prior to steam curing. This permits the tongue and groove configuration 18 to be made in mating panels 12 as seen in FIG. 1. It also permits ready drilling of the through holes 20 in the panels which allow them to be bolted together. Another significant advantage of autoclave cellular concrete is its very good heat insulating properties. Additionally, and perhaps most importantly, the autoclave cellular concrete can also withstand very high temperatures without material degradation. The autoclave cellular concrete is capable of withstanding the temperatures of the oil fire without degradation of its integrity.

Figure 5:
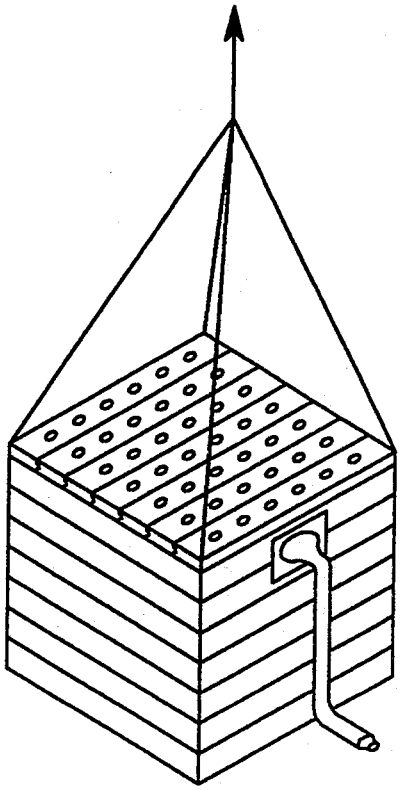
FIG. 5 illustrates the technique for lifting a box over the well to be controlled.

In use, the box 10 would be placed over the burning oilwell by a crane or other suitable lifting apparatus as illustrated in FIG. 5. The box 10 has a series of vent holes 22 in the top 24 of the box. The holes 22 are preferably 10 inch diameter vent holes at 24 inch on center. The sides 26 are preferably solid, with the exception of a heat resistant pipe connection 28 passing through one wall as seen in FIG. 1. The heat resistant pipe connection 28 is preferably provided with a quick release nozzle to force feed powdered or crumbled autoclave cellular concrete or fire retardant into the interior of the box 10. A heat resistant flexible apron 30 is mounted around the bottom edges of the sides 26 of the box to lay along the ground surface.

The purpose of the box 10 is to provide control over the burning fire. The box will not extinguish the fire itself, as the fire can continue to pass up through the vent holes 22. However, the box 10 does act to control to some extent the direction and velocity of the flames.

To extinguish the fire, it is contemplated to force powdered or crumbled autoclave cellular concrete material or other fire retardant through the pipe connector 28 and into the interior of the box 10 to fill the interior of the box and snuff out the fire. Once the fire is extinguished, the box 10 can be removed and a conventional treatment of the oilwell undertaken to cap the well. Alternatively, the procedures discussed hereinafter can be initiated.

Figure 2:
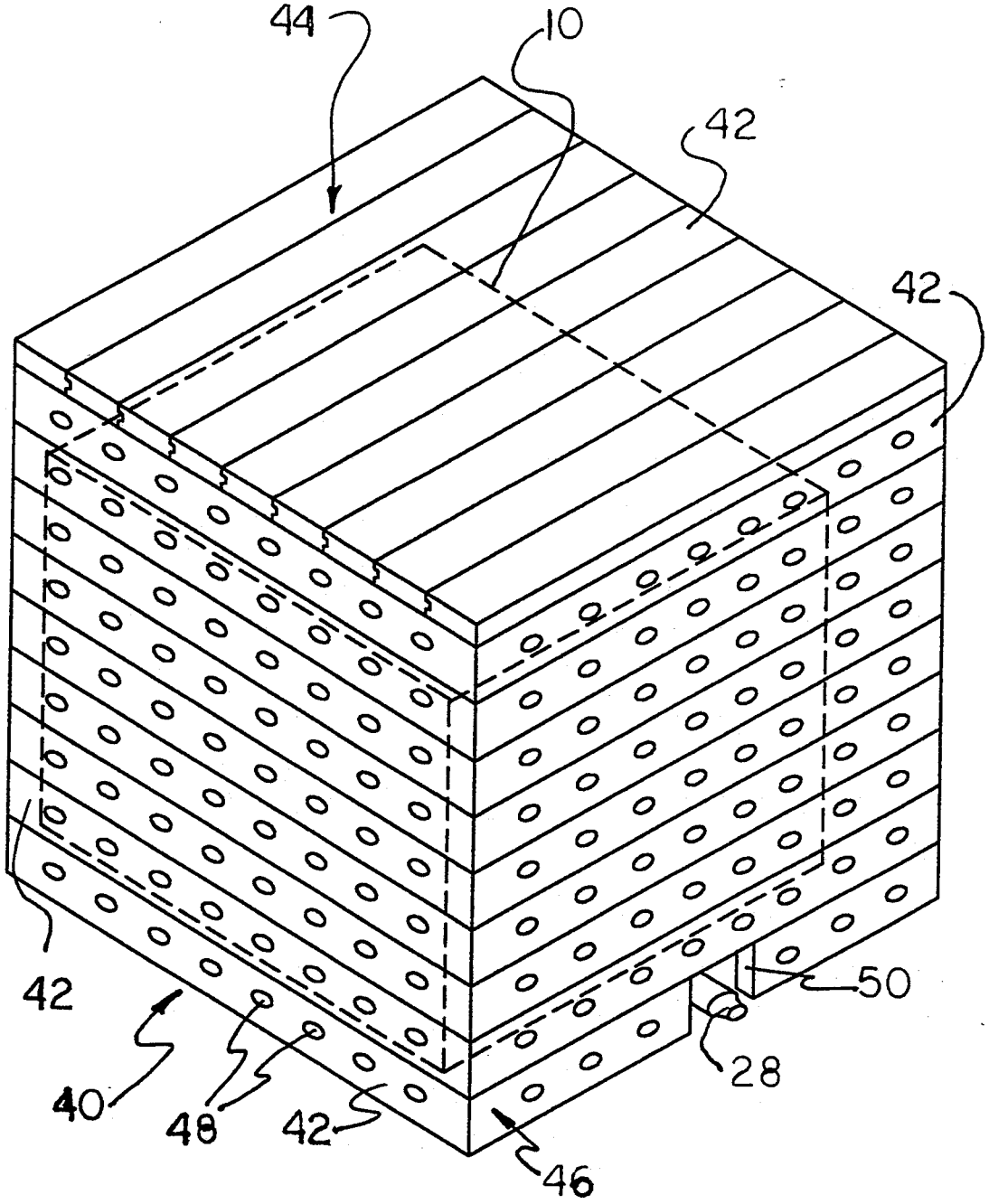
FIG. 2 is a perspective view of a second box which can be used with the first box.

FIG. 2 illustrates a box 40 which is similar in construction to box 10, being formed of a number of autoclave cellular concrete panels 42. However, the top 44 of box 40 has no vent holes, while each of the sides 46 has a plurality of vent holes 48. The dimensions of the box 40 are sized to fit over the box 10, as seen in FIG. 2, with some clearance between the boxes. Spacing elements can be used to square the box 40 over the box 10, if desired. Also, a gap 50 can be formed through one side 46 of the box 40 for passage of the pipe connector 28. This gap can be intended to simply prevent interference with the connector, or the connector can be used to supply powdered or crumbled autoclave cellular concrete material into the interior of box 10 to extinguish the fire after the box 40 has been put over the box 10. When the oil and natural gas continues to escape from the well, the positioning of the vent holes 48 on the sides of box 40 will cooperate with the vent holes 22 through the top of box 10 to provide a more controlled path for the oil or gas. The vents 48 are preferably 10 inch diameter vent holes at 24 inch on center.

Figure 3:
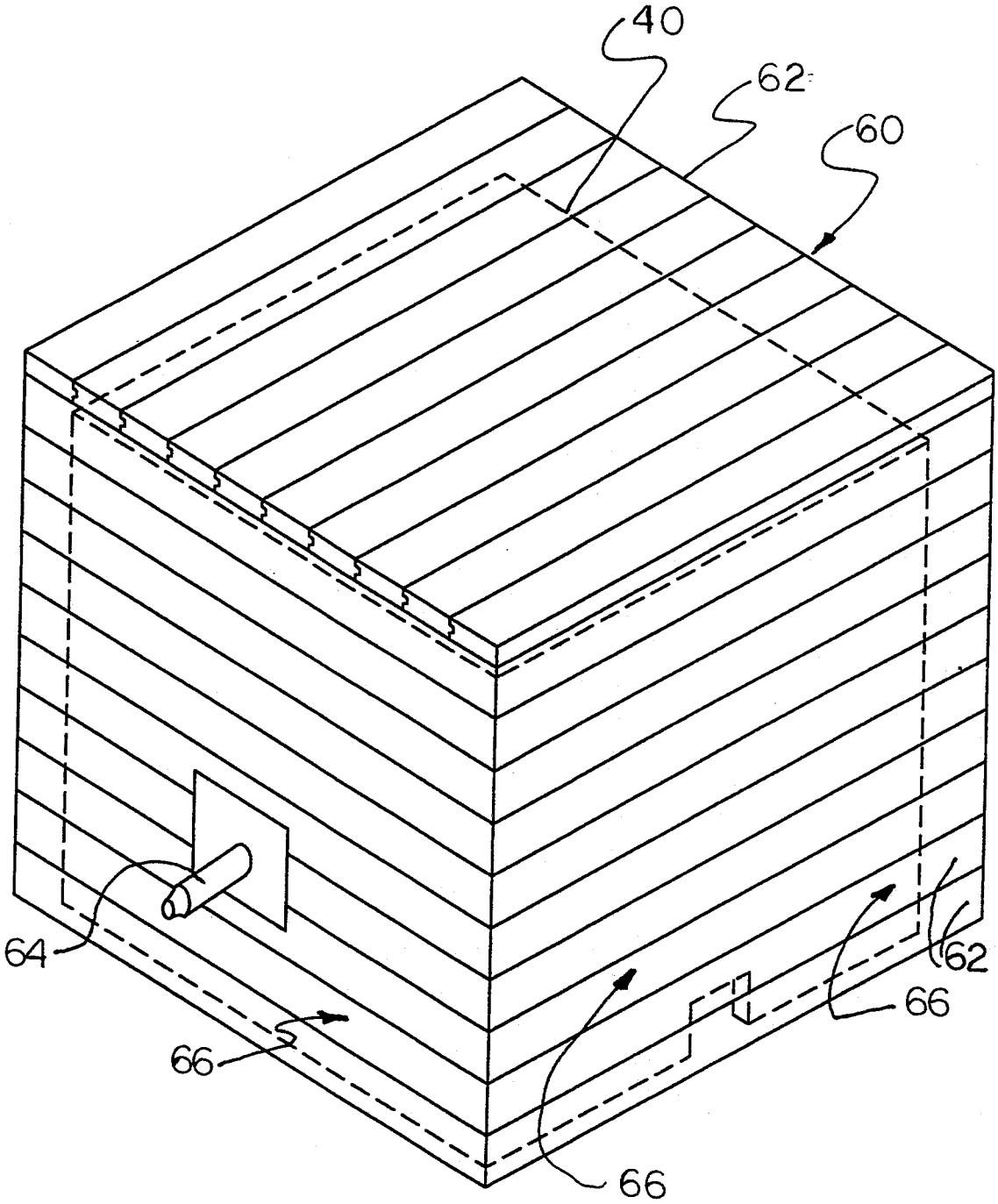
FIG. 3 is a perspective view of a third box which can be fitted over the previous boxes to permit production from the well.
Figure 3A:
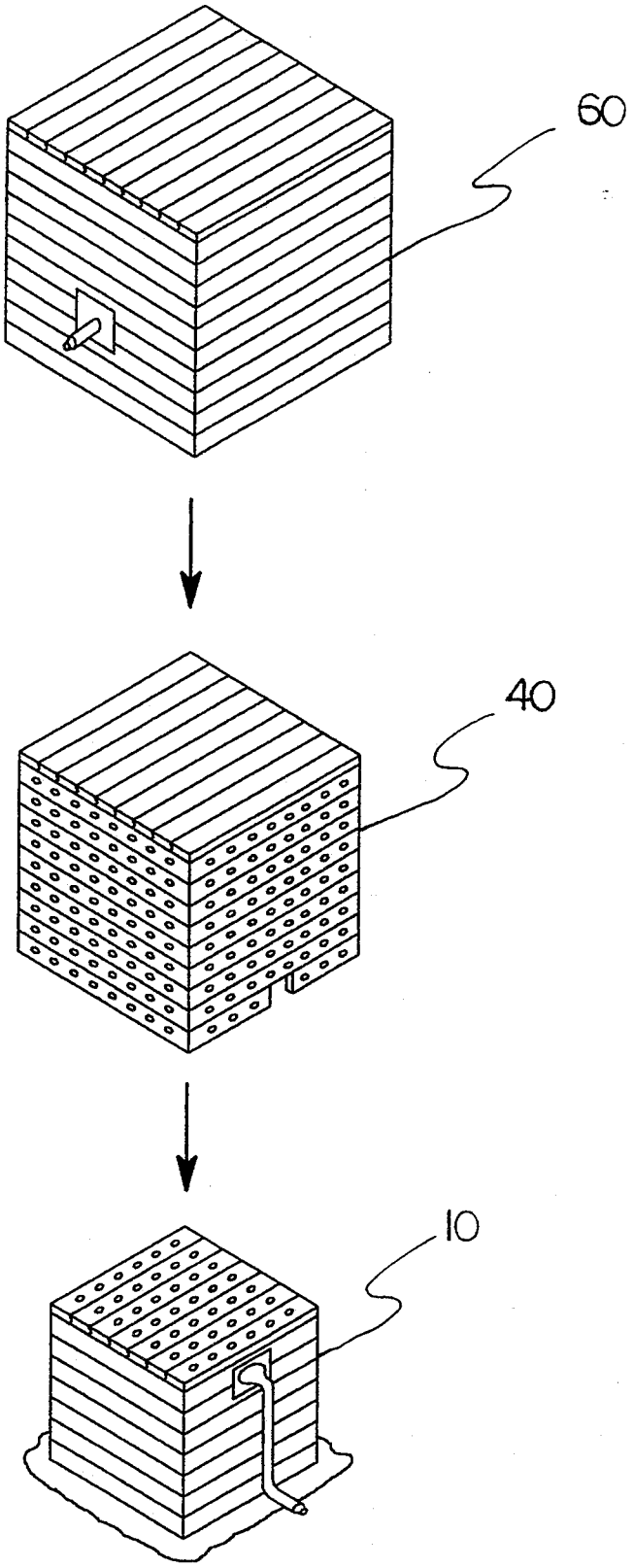
FIG. 3A is a perspective view of the three boxes illustrating how the boxes fit over each other.

Box 60, seen in FIG. 3, can then be placed over box 40. The box 60 is similar in construction to the boxes 10 and 40, and is also made of autoclave cellular panels 62. The panels 62 have no vent holes at all. However, a discharge valve 64 is mounted in one side 66 of the box 60. The box 60 will be placed over the well after the fire has been extinguished. The bottom edges of the sides 66 of the box 60 will be caulked or sealed to the ground and the oil and gas within the interior of the boxes 10, 40 and 60 will have nowhere to go but out the discharge valve 64. The valve 64 can be connected to a storage tank or oil and gas separator to process the hydrocarbons issuing from the oilwell. Preferably, a recessed heat resistant plate is provided on each side of the autoclave cellular concrete wall for attachment of the valve 64. In effect, the positioning of box 60 in this manner will return the oilwell to production and allow some control over the oil flow. This production can be continued for as long as the well is produced, or can be a temporary production solution used only as long as is necessary until the well can be more traditionally recovered.

While the size of the boxes would be determined by the size necessary for a particular well, it is possible to obtain panels of autoclave cellular concrete having a 24-foot length. The resultant boxes can be expected to resist well head pressures up to 7,500 PSI and temperatures in excess 2300° F.

Many variations in use of the boxes can be contemplated. It may be possible to put out the fire by using box 10, which is then removed. The box 60 can then be put in place to allow production, with box 40 never being used. Alternatively, the fire can be extinguished with a conventional technique, such as an explosion, and a box 60 positioned over the well for production.

Although several embodiments of the invention have been illustrated in the accompany drawings and described in the foregoing Detailed Description, it will be understood that the invention is not limited to the embodiments disclosed, but is capable of numerous rearrangements, modifications, and substitutions of parts and elements without departing from the scope and spirit of the invention.

I claim:

1. An apparatus for extinguishing a well fire at a well comprising a box formed of autoclave cellular concrete having four sides and a top, the box being placed over the well to control the fire, and a second box formed of autoclave cellular concrete, said second box having four sides and top, the second box sized to fit over the first box to provide additional control of the well fire.

* * * * *